US007874115B2

(12) United States Patent
Thiede

(10) Patent No.: US 7,874,115 B2
(45) Date of Patent: Jan. 25, 2011

(54) MODULAR FLOOR

(75) Inventor: Martin E. Thiede, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 1520 days.

(21) Appl. No.: 10/773,571

(22) Filed: Feb. 6, 2004

(65) Prior Publication Data

US 2004/0211137 A1 Oct. 28, 2004

Related U.S. Application Data

(60) Provisional application No. 60/445,618, filed on Feb. 7, 2003.

(51) Int. Cl.

| | |
|---|---|
| ***E04B 9/00*** | (2006.01) |
| ***E04B 5/00*** | (2006.01) |
| ***E04B 1/00*** | (2006.01) |
| ***E04C 2/52*** | (2006.01) |
| ***E04H 12/00*** | (2006.01) |

(52) U.S. Cl. ..... 52/506.01; 52/220.1; 52/126.6; 52/637; 52/745.05

(58) Field of Classification Search ..... 52/79.5, 52/109, 220.1, 220.2, 220.3, 506.01, 220.5, 52/126.5, 126.6, 633, 637, 638, 262, 263, 52/581, 745.05, 745.13, 655.1, 726.2, 126.2; 403/321, 322.1, 330

See application file for complete search history.

(56) References Cited

U.S. PATENT DOCUMENTS

| | | | | |
|---|---|---|---|---|
| 2,479,962 | A * | 8/1949 | Paulson | 52/637 |
| 2,981,365 | A | 4/1961 | Olsen | |
| 3,084,911 | A | 4/1963 | Spiselman | |
| 3,094,848 | A | 6/1963 | Albrecht | |
| 3,100,624 | A | 8/1963 | Spiselman | |
| 3,150,748 | A | 9/1964 | Liskey, Jr. | |
| 3,157,254 | A | 11/1964 | Spiselman et al. | |
| 3,180,460 | A * | 4/1965 | Liskey, Jr. | 52/479 |
| 3,258,884 | A | 7/1966 | Wenger | |
| 3,400,502 | A | 9/1968 | Scaggs et al. | |
| 3,425,179 | A * | 2/1969 | Haroldson | 52/283 |
| 3,462,110 | A | 8/1969 | Cheslock | |
| 3,470,663 | A | 10/1969 | Tate | |
| 3,599,382 | A | 8/1971 | Stone | |
| 3,606,704 | A | 9/1971 | Denton | |

(Continued)

FOREIGN PATENT DOCUMENTS

| | | |
|---|---|---|
| CA | 753000 | 2/1967 |
| FR | 2418319 | 9/1979 |
| GB | 1291709 | 10/1972 |
| WO | WO 03 038209 | 5/2003 |

*Primary Examiner*—Richard E Chilcot, Jr.
*Assistant Examiner*—Ryan D Kwiecinski
(74) *Attorney, Agent, or Firm*—Patterson Thuente Christensen Pedersen, P.A.

(57) ABSTRACT

A modular floor including a pair of main beams, at least one cross beam and a floor panel. The pair of main beams each has an attachment structure. The attachment structure includes a first support section, a second support section and a channel that extends between the first and second support sections. The first and second support sections have a convex upper surface. The at least one cross beam engages the main beams to retain the main beams in a stationary position with respect to each other. The floor panel has ends that each have a recess that is shaped complementary to the upper surfaces of the first and second sections.

24 Claims, 15 Drawing Sheets

U.S. PATENT DOCUMENTS 3,964,402 A 6/1976 Jenne et al.
3,971,181 A 7/1976 Zetlin
4,009,550 A 3/1977 Young
4,026,221 A 5/1977 Wilson et al.
4,044,523 A 8/1977 Layher
4,050,257 A 9/1977 Parks et al.
4,054,096 A 10/1977 Wilson et al.
4,180,342 A 12/1979 Layher
4,319,520 A 3/1982 Lanting et al.
4,327,650 A 5/1982 Bue
4,340,929 A 7/1982 Konikoff
4,350,318 A * 9/1982 Gallis ..... 249/40
4,485,598 A 12/1984 Guardiani
4,503,651 A * 3/1985 Pugh ..... 52/639
4,558,544 A 12/1985 Albrecht
4,580,776 A 4/1986 Burkinshaw
D284,418 S 6/1986 Tseng
4,606,156 A 8/1986 Sweers
4,617,689 A * 10/1986 Nelson et al. ..... 5/400
4,625,491 A 12/1986 Gibson
4,630,417 A * 12/1986 Collier ..... 52/263
4,638,604 A 1/1987 Rogers et al.
4,652,170 A 3/1987 Lew
4,656,795 A 4/1987 Albrecht
4,676,036 A * 6/1987 Bessert ..... 52/126.6
4,685,258 A * 8/1987 Av-Zuk ..... 52/126.6
4,759,162 A 7/1988 Wyse
4,779,542 A 10/1988 Staten et al.
D300,073 S 2/1989 Crump
4,811,530 A 3/1989 Eyerly
4,825,976 A 5/1989 Wyse
4,843,792 A 7/1989 Rogers et al.
4,845,915 A 7/1989 Rogers et al.
D304,499 S 11/1989 Rogers et al.
4,901,490 A 2/1990 Zinniel et al.
4,912,887 A 4/1990 Sullivan
4,917,217 A 4/1990 Rogers et al.
4,919,230 A 4/1990 Langer et al.
RE33,220 E * 5/1990 Collier ..... 52/263
4,922,670 A * 5/1990 Naka et al. ..... 52/126.6
4,930,277 A 6/1990 Krumholz et al.
4,934,113 A 6/1990 Hall et al.
4,941,763 A 7/1990 Euteneuer
4,942,708 A 7/1990 Krumholz et al.
4,949,649 A 8/1990 Terres et al.
4,988,131 A 1/1991 Wilson et al.
5,022,200 A 6/1991 Wilson et al.
5,048,242 A * 9/1991 Cline ..... 52/126.6
5,048,995 A 9/1991 Beaulieu
5,050,353 A 9/1991 Rogers et al.
5,117,596 A 6/1992 Leslie et al.
5,157,109 A 10/1992 Boers
5,157,890 A 10/1992 Jines
5,177,913 A 1/1993 Erel
5,205,087 A * 4/1993 Jines ..... 52/6
5,263,296 A * 11/1993 Spera ..... 52/638
5,269,619 A 12/1993 Warkus et al.
5,301,480 A 4/1994 Oyama et al.
5,323,563 A * 6/1994 Rogers et al. ..... 52/7
5,325,640 A 7/1994 Luedke et al.
5,349,789 A 9/1994 Andert et al.
5,392,718 A 2/1995 Stevens
5,425,214 A 6/1995 Truelove et al.
5,477,649 A * 12/1995 Bessert ..... 52/263
5,647,650 A 7/1997 Daugherty et al.
5,647,682 A 7/1997 Riehm
5,746,561 A 5/1998 Nygren et al.
5,768,850 A 6/1998 Chen
5,791,096 A * 8/1998 Chen ..... 52/126.6
5,848,501 A 12/1998 Taipale et al.
6,006,680 A 12/1999 Quam et al.
6,014,936 A 1/2000 Rogers et al.
6,106,186 A 8/2000 Taipale et al.
6,442,805 B2 * 9/2002 Pfister ..... 24/514
6,463,704 B1 * 10/2002 Jette ..... 52/125.2
6,513,785 B1 * 2/2003 Worley ..... 249/18
6,519,902 B1 * 2/2003 Scissom ..... 52/126.4
6,581,339 B2 6/2003 Thiede
6,871,454 B2 * 3/2005 Coday et al. ..... 52/126.6
6,928,782 B2 * 8/2005 Becker et al. ..... 52/696
7,168,212 B2 * 1/2007 Jette ..... 52/220.5
7,377,491 B2 * 5/2008 Fuoco ..... 256/65.03
2002/0078638 A1 * 6/2002 Huang ..... 52/126.6
2003/0051420 A1 * 3/2003 Leon ..... 52/126.6

* cited by examiner

MODULAR FLOOR

REFERENCE TO RELATED APPLICATION

The present application claims priority to U.S. Provisional Application No. 60/445,618, filed Feb. 7, 2003. The identified provisional application is hereby incorporated by reference in its entirety.

FIELD OF THE INVENTION

The present invention relates generally to a modular floor. More particularly, the present invention relates to a modular floor for use with a tent.

BACKGROUND OF THE INVENTION

In many situations, it is desirable to construct a floor for temporary use. The floor must be easy to assemble and disassemble and must be sufficiently strong to support weights placed thereon.

Modular flooring systems are disclosed in Taipale et al., U.S. Pat. Nos. 5,848,501 and 6,106,186, which are assigned to the assignee of the present application. The modular flooring system uses universal connector mechanisms for slidably interlocking the beams with the support posts.

Another modular flooring system is disclosed in Thiede, U.S. Pat. No. 6,581,339, which is assigned to the assignee of the present application. This modular flooring system is particularly suited for filling an orchestra pit to thereby provide a floor that is approximately aligned with a stage that is adjacent to the modular floor.

SUMMARY OF THE INVENTION

The present invention is a modular floor that generally includes main beams and cross beams that are attached together to form a grid. The modular floor also includes a plurality of floor panels that are attached to the grid.

DETAILED DESCRIPTION OF THE PREFERRED EMBODIMENTS

Figure 1:
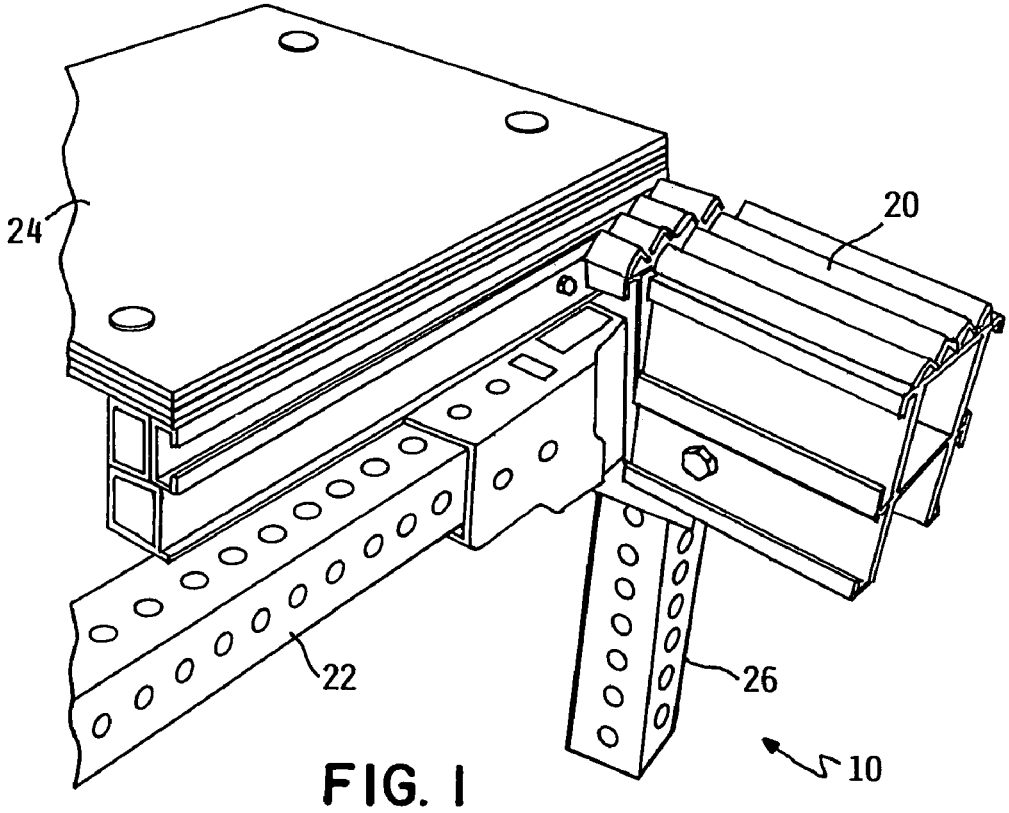
FIG. 1 is a perspective view of a modular floor according to the present invention.

The present invention is modular floor, as most clearly illustrated in FIG. 1. The modular floor 10 generally includes a main beam 20, a cross beam 22, and a floor panel 24. Depending upon the surface over which the modular floor 10 is used, the modular floor 10 may also include one or more legs 26 to change the elevation of the modular floor 10.

The modular floor 10 is designed to permit relatively quick installation of the modular floor 10 in a variety of applications such as in a tent or over a pool. By using the concepts of the present invention, the modular floor 10 is a significant improvement of prior flooring systems. The modular floor 10 of the present invention also enables the floor panels 24 to be adjustably positioned with respect to main beams 20 to increase the flexibility of the modular floor 10.

Figure 2:
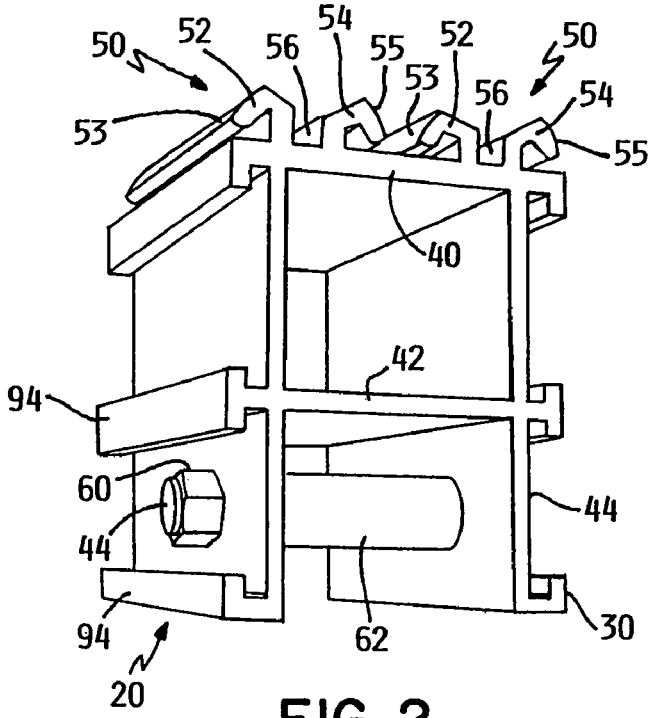
FIG. 2 is a side view of a main beam for use with the modular floor.
Figure 3:
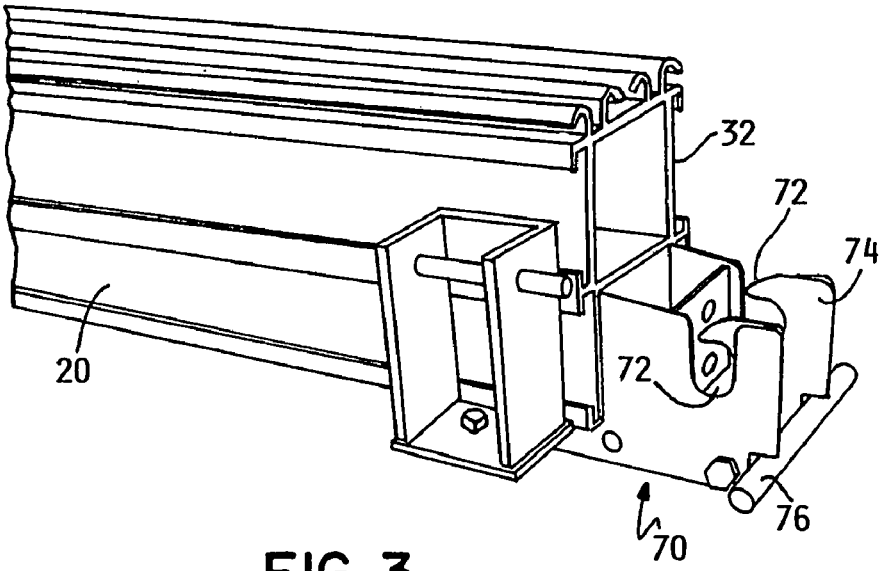
FIG. 3 is a perspective view of a second end of the main beam with a locking mechanism in a locked position.
Figure 4:
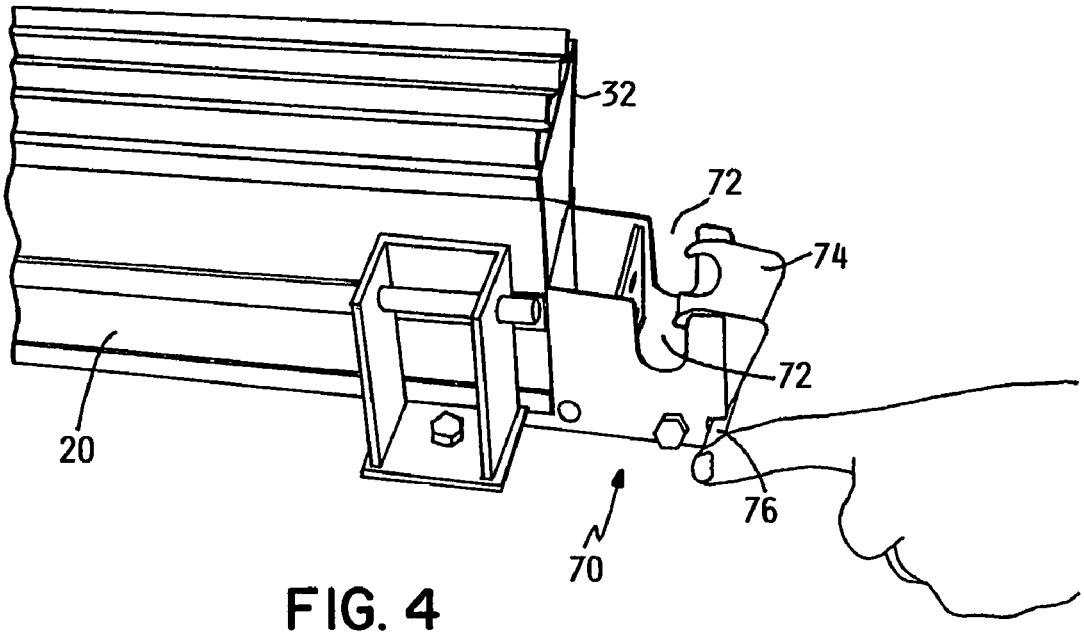
FIG. 4 is a perspective view of the second end of the main beam with the locking mechanism in an unlocked position.

The main beam 20 has an elongated configuration with a first end 30, which is most clearly illustrated in FIG. 2, and a second end 32, which is most clearly illustrated in FIGS. 3-4. To provide the main beam 20 with a desired degree of structural rigidity, the main beam preferably includes a top wall 40, a bottom wall 42, and a pair of side walls 44. The side walls 44 preferably extend below the bottom wall 42 to facilitate attachment of main beams 20 to each other, as is discussed in more detail below.

The main beam 20 preferably includes two attachment structures 50 extending from the top wall 40. The attachment structures 50 are used for attaching the floor panels 24 to the main beams 20. Each of the attachment structures 50 includes a first support section 52 and a second support section 54, which are shaped substantially complimentary to each other.

Upper surfaces 53, 55 of the first and second support sections 52, 54, respectively, define a semi-circular or convex shape. Extending between the first and second support sections 52, 54 is a channel 56. The walls of the channel 56 preferably have a threaded surface to facilitate attaching the floor panels 24 to the main beam 20 as is discussed in more detail below.

proximate the first end 30, the main beam 20 has a bolt 60 that extends between the side walls 44. A plastic sleeve 62 is preferably placed over the bolt 60.

Proximate the second end 32, the main beam 20 has a locking mechanism 70, which is adapted to engage the bolt 60 for attaching main beams 20 to each other. The locking mechanism 70 generally has a U-shaped configuration. Sides of the locking mechanism 70 have a recess 72 formed therein that is adapted to receive the bolt 60.

The locking mechanism 70 also includes a locking tooth assembly 74. The locking tooth assembly 74 is pivotally mounted to the locking mechanism 70 and is biased to a locking position. When in the locking position, the locking tooth assembly 74 substantially closes the recess 72 to retain the bolt 60 in the recess 72.

The locking tooth assembly 74 includes a handle portion 76, which facilitates moving the locking tooth assembly 74 from the locking position (illustrated in FIG. 3) to the unlocking position (illustrated in FIG. 4).

Figure 5:
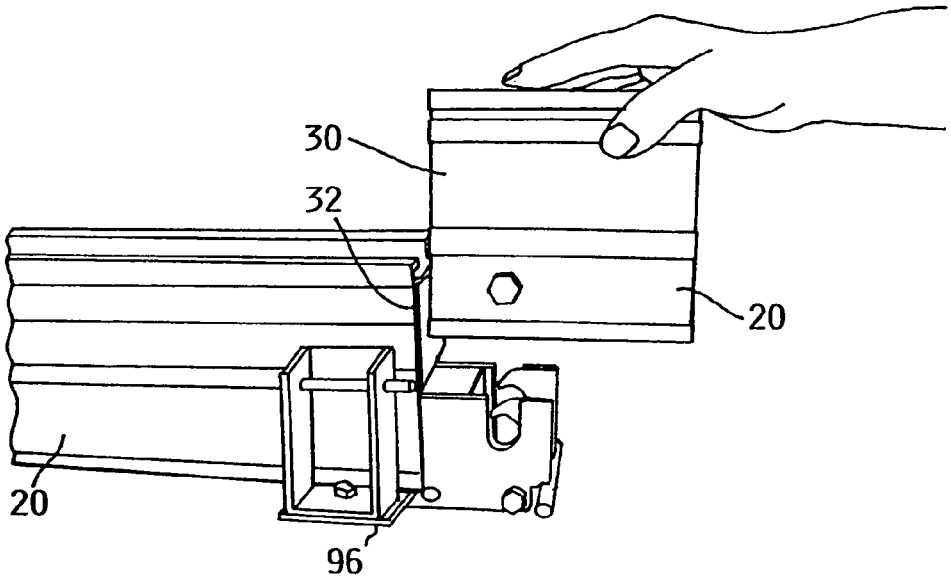
FIG. 5 is a side view illustrating positioning the first and second ends of the main beams adjacent each other.
Figure 6:
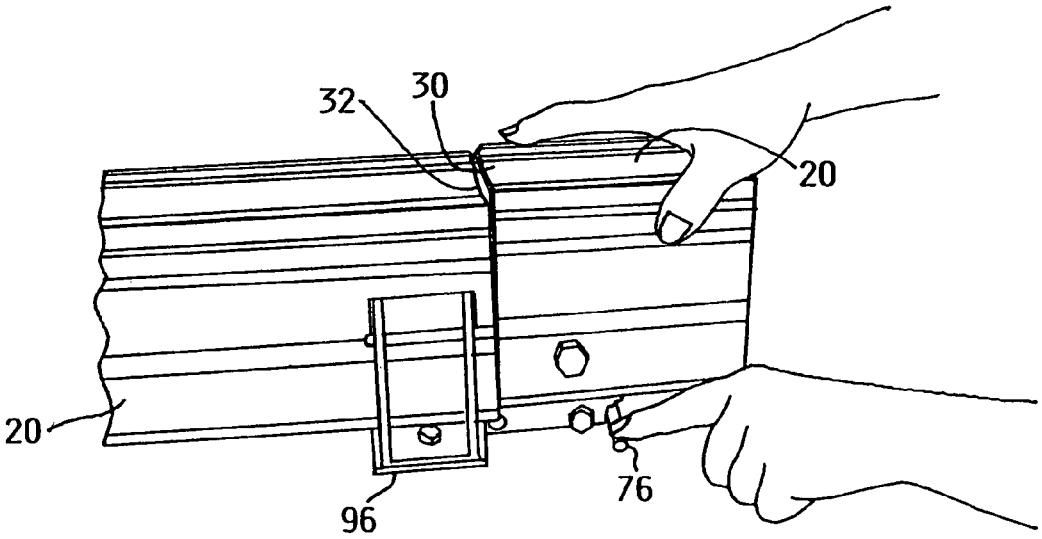
FIG. 6 is a side view illustrating moving the locking mechanism to the unlocked position so that the main beams can be attached to each other.

When attaching the main beams 20 together, the main beams 20 are positioned so that the first end 30 of one main beam 20 is adjacent the second end 32 of another main beam 20, as illustrated in FIG. 5. The first end 30 is lowered to the height of the second end 32 while the handle portion 76 is depressed to move the locking tooth assembly 74 to the unlocking position, as illustrated in FIG. 6.

Figure 7:
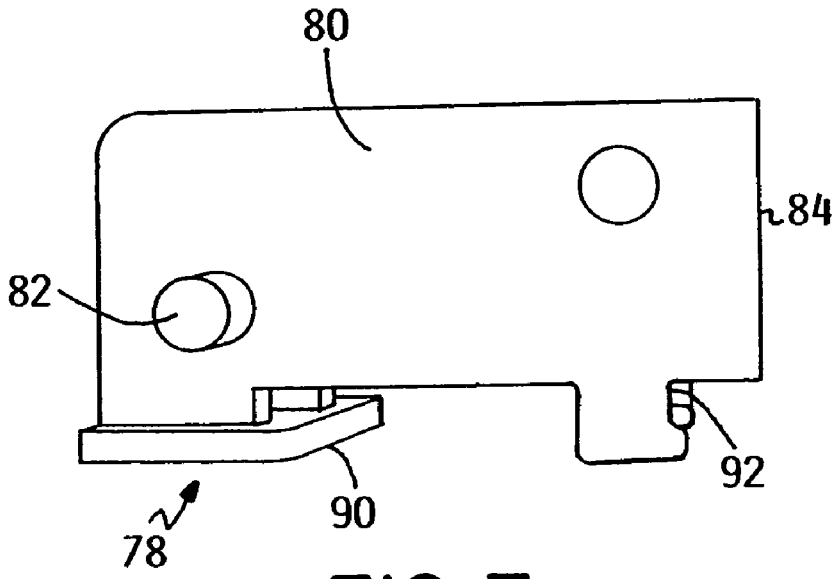
FIG. 7 is a side view of an attachment bracket for use with the modular floor.
Figure 8:
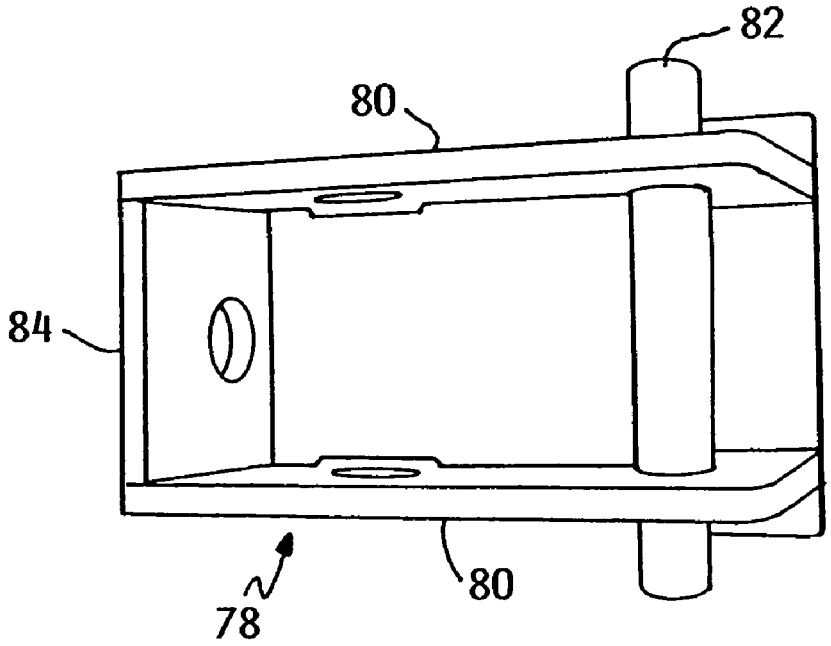
FIG. 8 is a front view of the attachment bracket.

The cross beam 22 is attached to the main beam 20 using an attachment bracket 78 that is illustrated in FIGS. 7-8. The attachment bracket 78 includes a pair of side walls 80 that extend beyond a lower wall 84. A post 82 extends between the side walls 80.

The attachment bracket 78 includes an upper tooth 90 and a lower tooth 92. The upper tooth 90 and the lower tooth 92 are adapted to engage extensions 94 on the side walls 44.

To prevent the attachment bracket 78 from moving with respect to the main beam 20, a plate 96 is attached to the lower wall 84 with a bolt (not shown). The plate 96 extends under the bottom wall 42.

Figure 9:
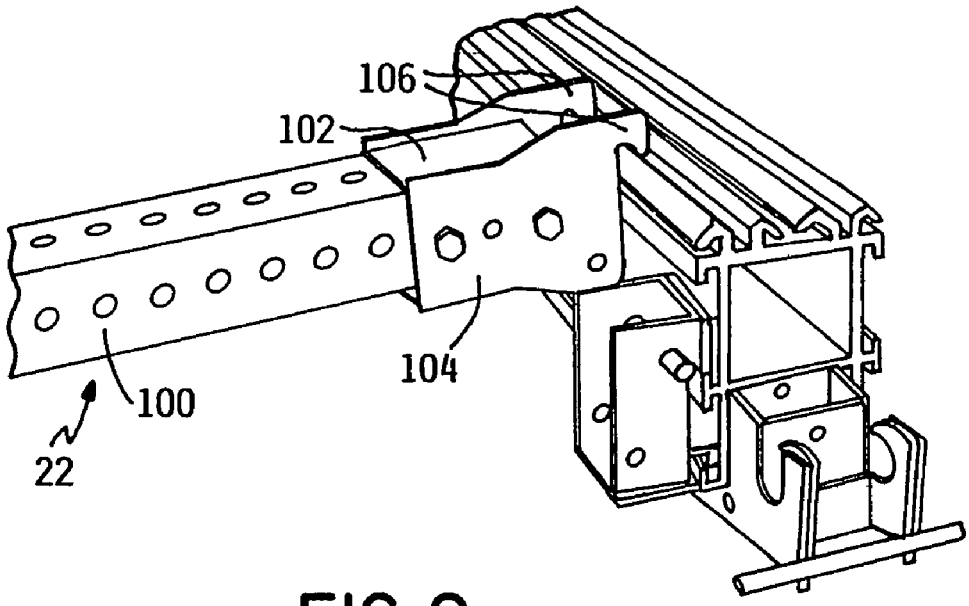
FIG. 9 is a perspective view of a cross beam adjacent the attachment bracket, which is mounted to the main beam.
Figure 10:
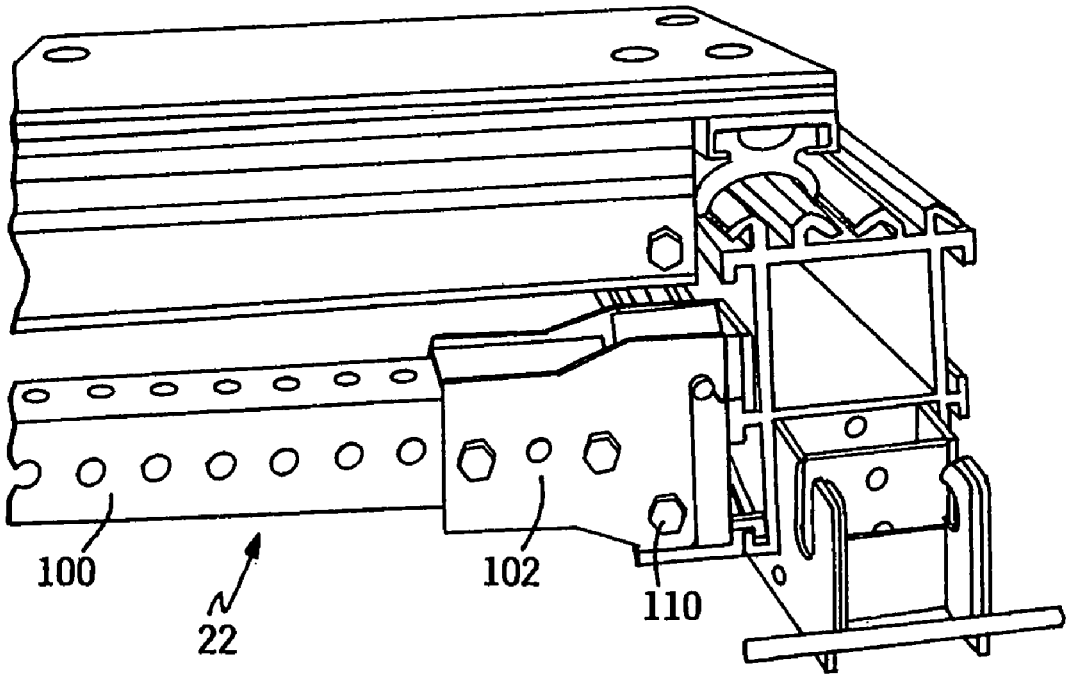
FIG. 10 is a perspective view of the cross beam attached to the main beam.

The cross beam 22 includes a main section 100 and an end section 102 that is mounted to an end of the main section 100, as illustrated in FIGS. 9 and 10. The end section 102 has a pair of side walls 104. Each of the side walls 104 has a hook 106 extending therefrom. The hook 106 extends over the post 82.

A screw 110 is preferably extended through the side walls 80 and the side walls 104 to maintain the cross beam 22 in a stationary position with respect to the main beam 20.

Figure 11:
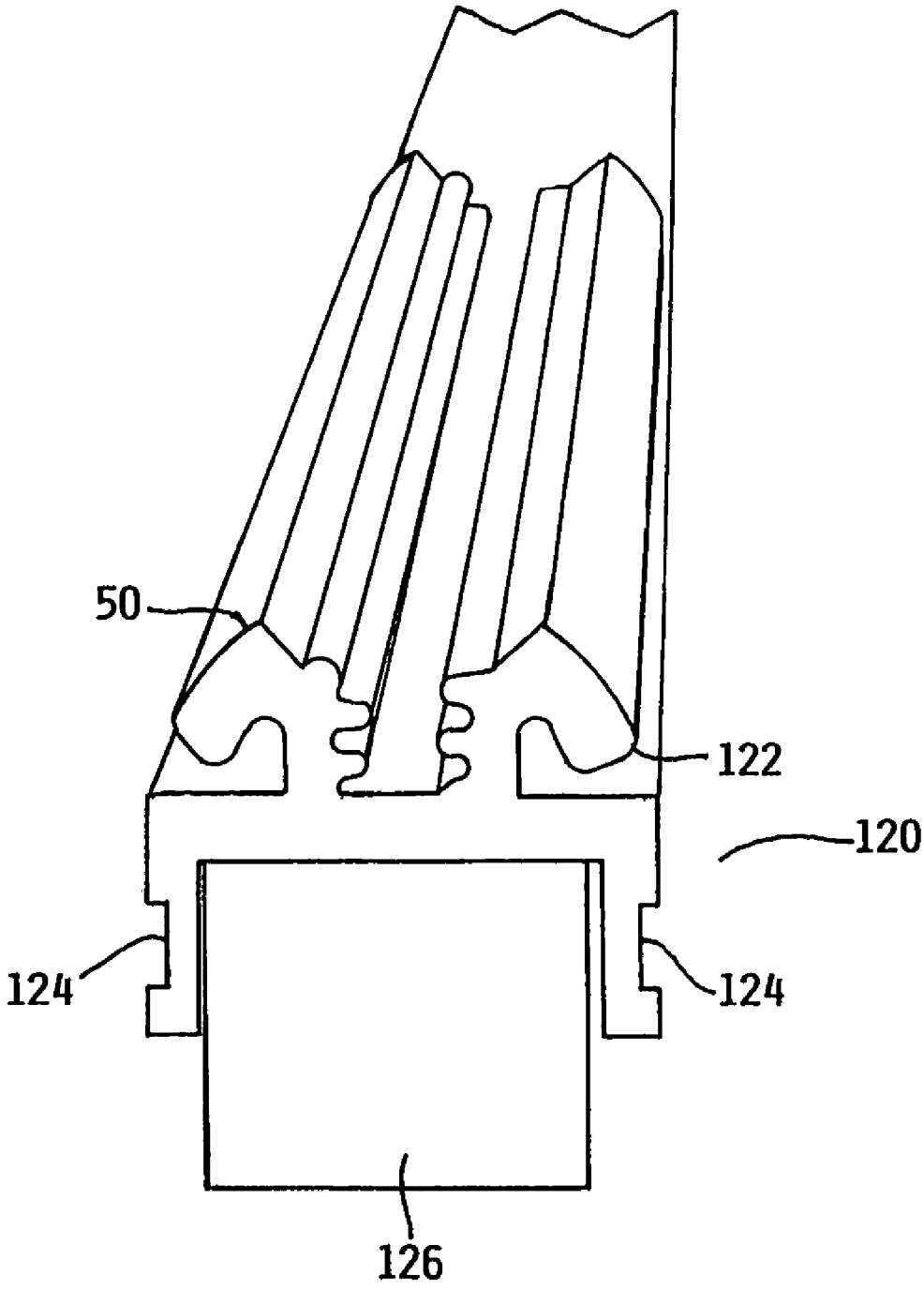
FIG. 11 is an end view of an alternative configuration of the side beam.

Using main beams 20 with two attachment structures 50 enables adjacent floor panels 24 to be mounted to the main beams 20. Along sides of the modular floor a side beam 120 is preferably used. The side beam 120 preferably only includes a single attachment structure 50, as illustrated in FIG. 11.

The side beam 120 illustrates an alternative configuration that only includes a top wall 122 and a pair of side walls 124. To strengthen the side beam 120, the wooden piece 126 is placed in a recess defined by the top wall 122 and the pair of side walls 124.

A person of ordinary skill in the art will appreciate that it is also possible to use the concepts of the present invention with other support structures such as a wooden composite structure that has an I-beam configuration with a top plate, a bottom plate and a center section that extends between the top plate and the bottom plate. Such a support structure would enable the modular floor to be used over larger structures such as over a pool.

Figure 12:
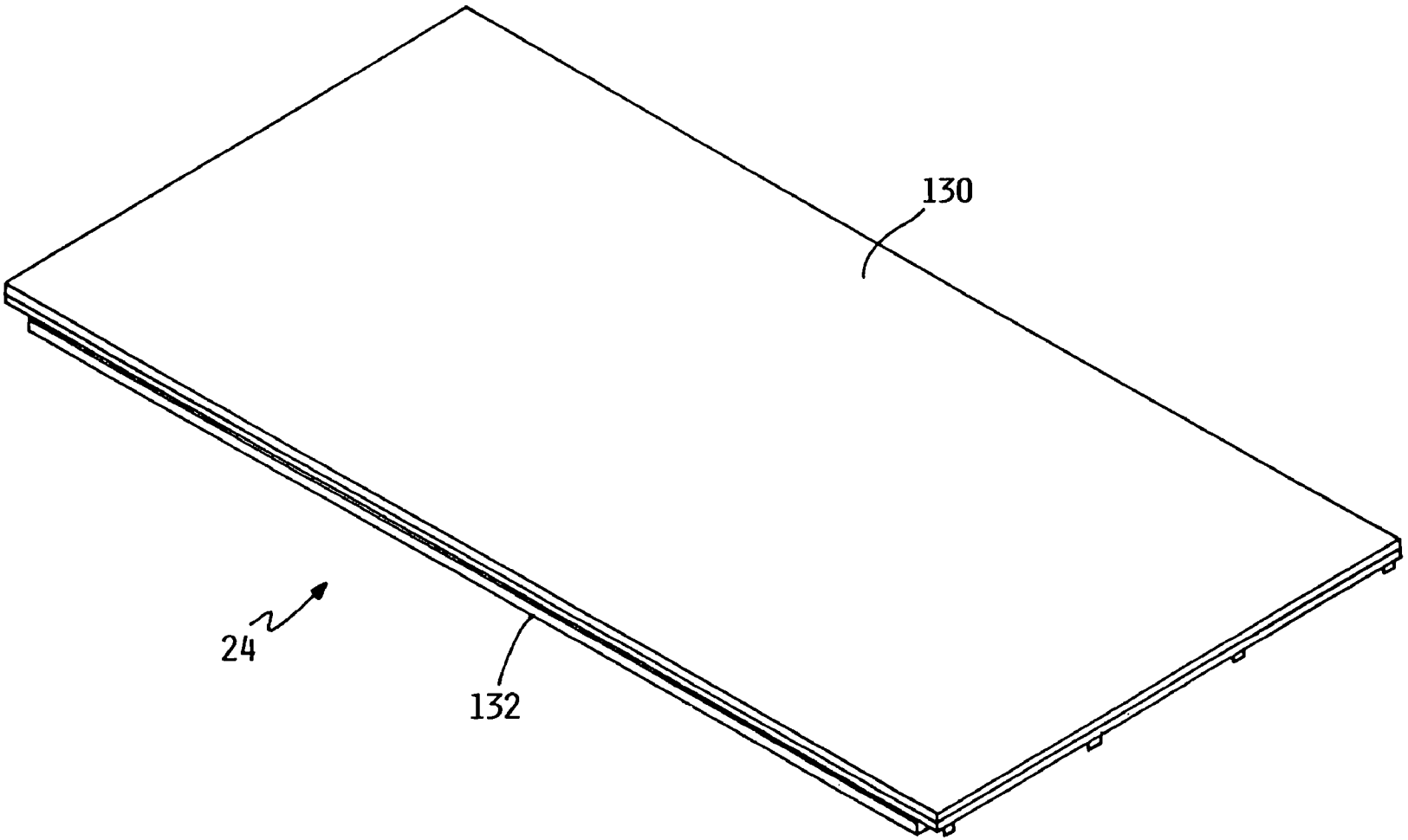
FIG. 12 is a perspective view of an upper surface of the floor panel.
Figure 13:
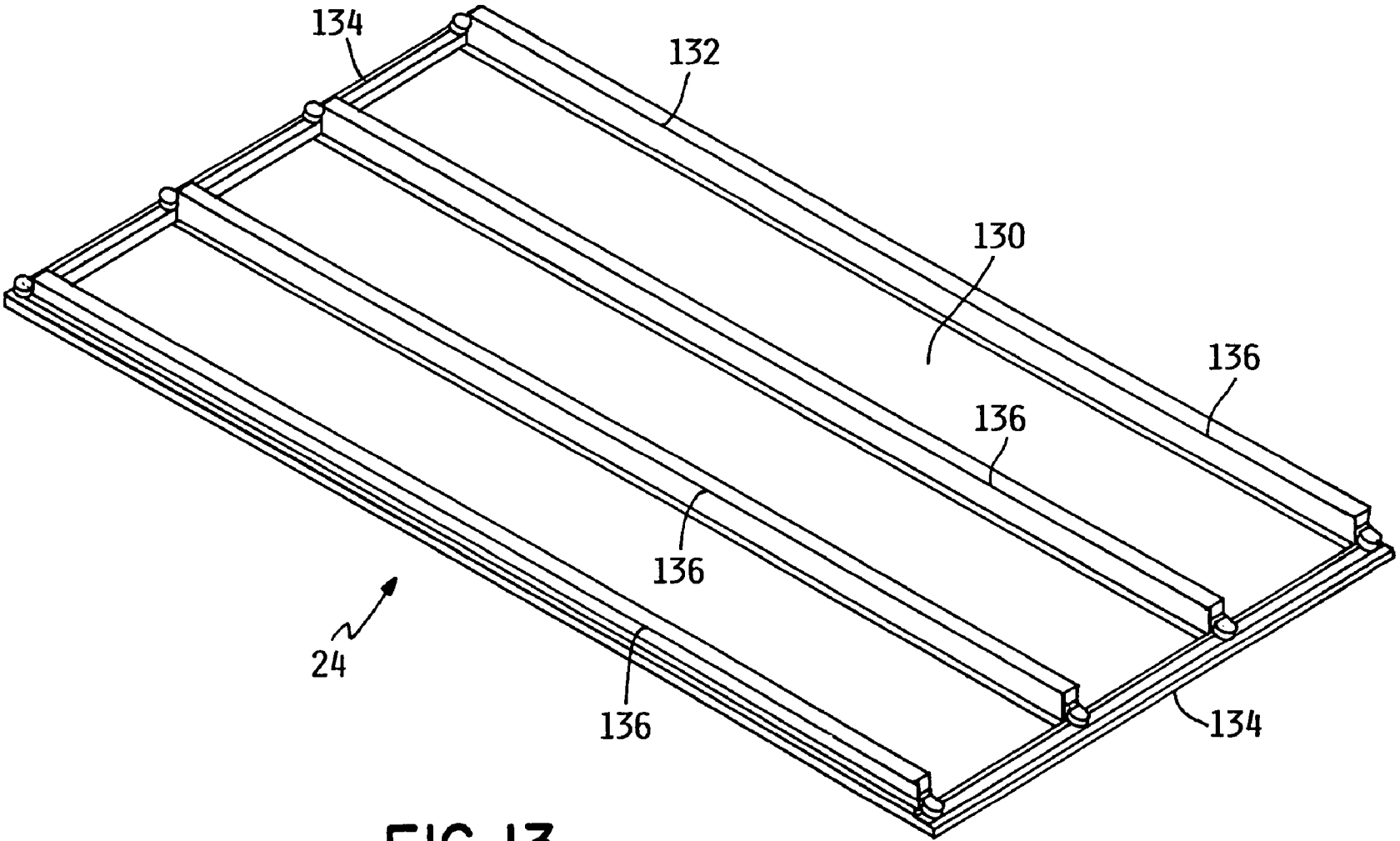
FIG. 13 is a perspective view of a lower surface of the floor panel.

The floor panel 24 preferably has a generally rectangular configuration as illustrated in FIGS. 12-13. A preferred size for the floor panel 24 is about 4 feet wide and about 8 feet long as forming the floor panel 24 with these dimensions enables the floor panel 24 to be manually carried. A person of ordinary skill in the art will appreciate that the concepts of the present invention may be adapted for use with different configurations and sizes of the floor panels 24.

The floor panel 24 generally includes a sheathing layer 130 and a support frame 132 to which the sheathing layer is attached. The sheathing layer 130 may be conventional plywood or it may have a finished upper surface such as with carpet or tile.

The support frame 132 preferably includes a pair of end beams 134 and a plurality of support beams 136 that extend between the end beams 134. The number of support beams 136 and the shape of the support beams 136 is selected based upon the desired capacity of the modular floor 10.

Figure 14:
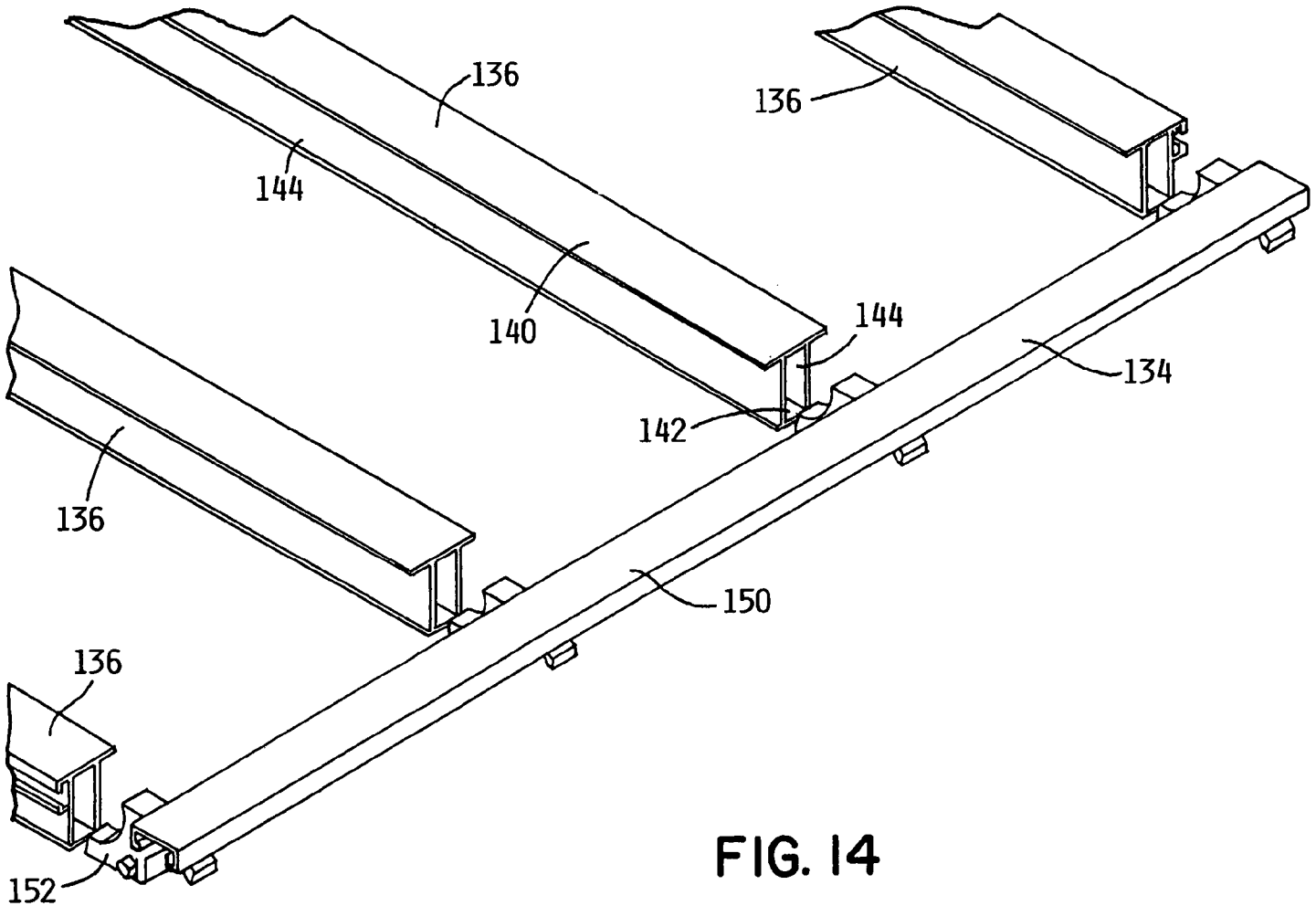
FIG. 14 is an exploded perspective view of support beams and an end beam of the floor panel.

The support beams 136 preferably have a top wall 140, a bottom wall 142 and a pair of side walls 144 that extend between the top wall 140 and the bottom wall 142, as illustrated in FIG. 14. The top wall 140 preferably extends beyond the side walls 144 to facilitate attachment of the support beams 136 to the sheathing layer 130.

Figure 15:
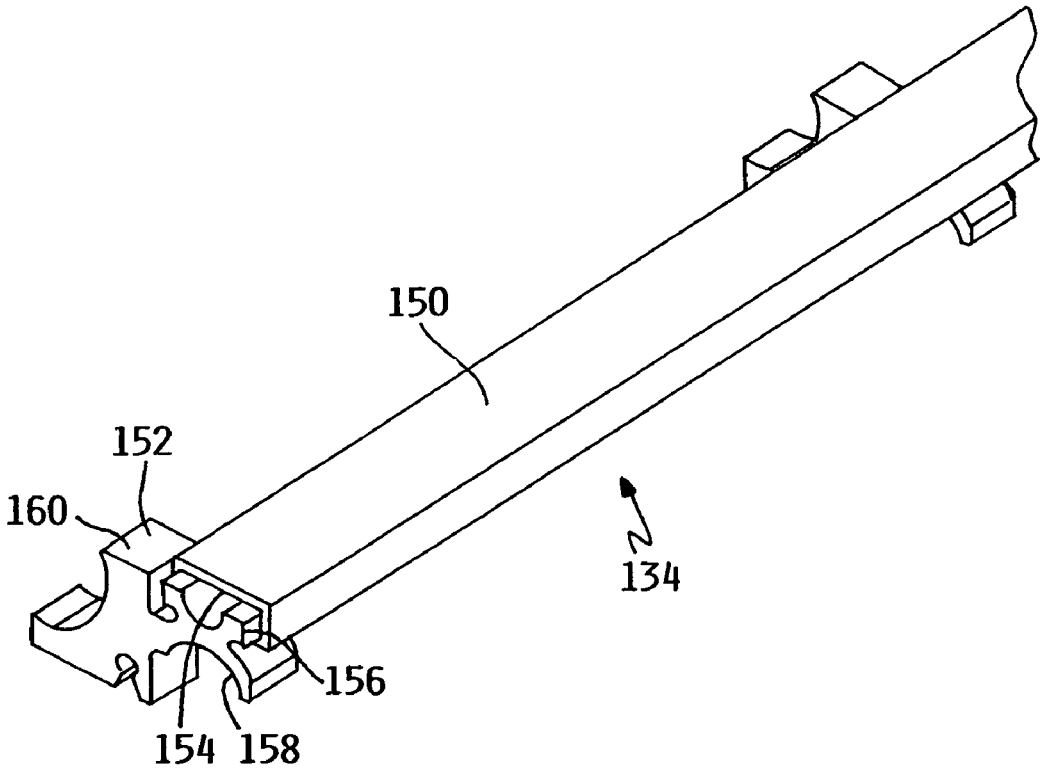
FIG. 15 is a perspective view of the end beam for the floor panel.

The end beams 134 preferably have an end track 150 and a plurality of adaptors 152 that engage the support beams 136, as illustrated in FIG. 15. The end track 150 preferably has a C-shaped configuration, which defines a recess 154. The recess 154 is adapted to receive a first section 156 on the adapters 152. The adapters 152 are retained in the end track 150 while being laterally slidable with respect to the end track 150 to adjust be position of the adapters 152.

Adjacent the first section 156, the adapters 152 have a second section 158. The second section 158 has a concave shape, which preferably conforms to the attachment structures 50. The second section 158 thereby facilitates sliding the floor panels 24 laterally along the attachment structures 50.

Opposite the first section 156 and the second section 158, the adapters 152 include an extension 160 that is sized to slide into a recess defined by the top wall 140, the bottom walls 142 and the side walls 144 for attachment of the end beams 134 to the support beams 136.

Figure 16:
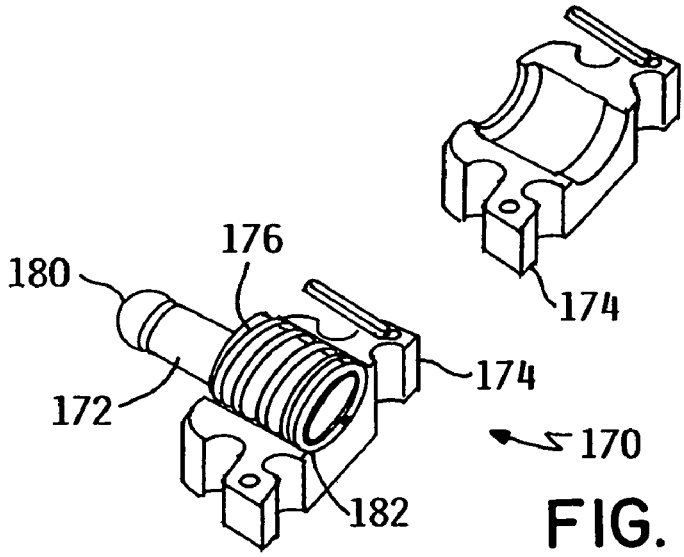
FIG. 16 is a perspective view of a lock screw for use with the modular floor.

The floor panels 24 are preferably attached to the side beams 20 with a lock screw 170, as most clearly illustrated in FIG. 16. The lock screw 170 generally includes a shaft 172, a housing 174 and a spring 176.

The shaft 172 has a first end 180 and a second end 182. The first end 180 preferably has a hex shaped recess (not shown) formed therein to facilitate utilizing the lock screw 170 with a conventional Allen wrench. The second end 182 has a threaded surface, which enables the lock screw 170 to engage the threaded surface in the channel 56.

Figure 17:
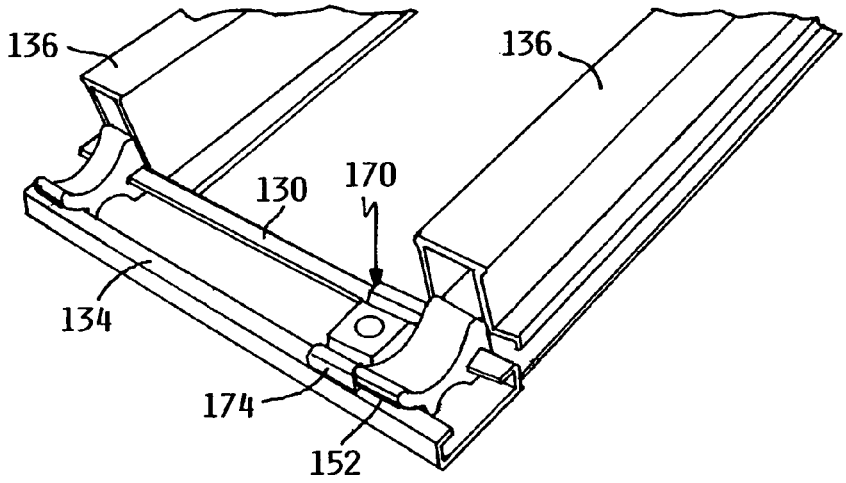
FIG. 17 is a perspective view of the lock screw attached to the floor panel.

The housing 174 extends around the shaft 172 and facilitates retaining the lock screw 170 in a stationary position with respect to the end beam 134 similar to the adapter 152, as illustrated in FIG. 17. By attaching the lock screw 170 to the end beam 134, it is less likely that the lock screw 170 will be misplaced.

The spring 176 biases the shaft 172 into a retracted position with respect to the housing 174 so that the shaft 172 does not interfere with sliding of the floor panels 24 with respect to the side beams 20 for assembly of the modular floor 10.

The modular floor 10 of the present invention also includes the ability to attach accessories along the sides of the modular floor 10. The accessories are preferably attached to either the main beam 20 or the cross beam 22 with an accessory attachment 180.

Figure 18:
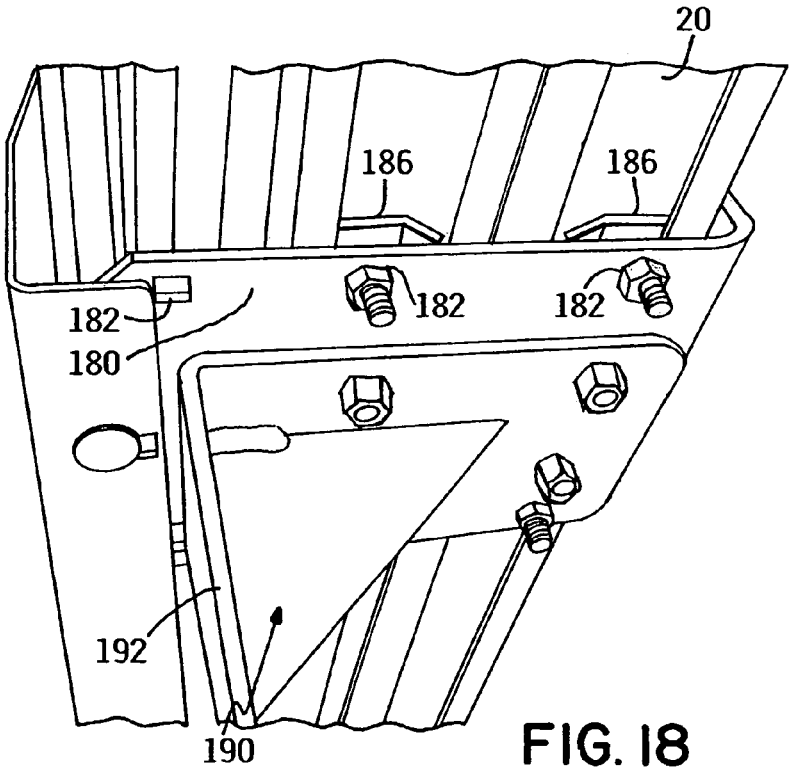
FIG. 18 is a side view of an accessory bracket attached to the main beam.

The accessory attachment 180 generally has a plate configuration, as illustrated in FIG. 18. The accessory attachment 180 includes a first plurality of apertures 182 and a second plurality of apertures (not shown). The first plurality of apertures 182 are used for attaching the accessory attachment 180 to the main beam 20 or cross beam 22 using clips 186.

Figure 19:
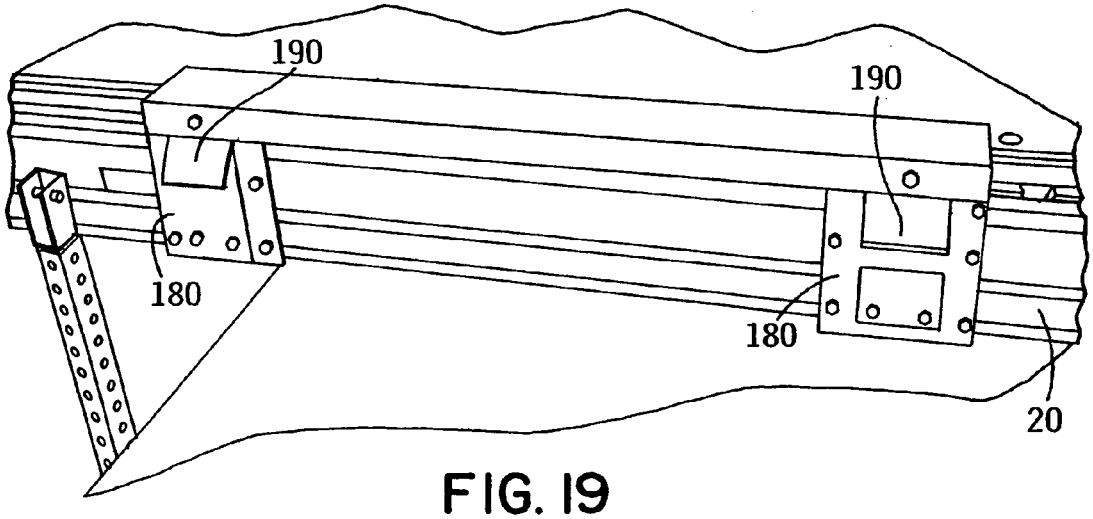
FIG. 19 is a front view of a stair attachment bracket mounted to the main beam with two of the accessory brackets.

The second plurality of apertures (not shown) are used for attaching an accessory mounting bracket 190 to the accessory attachment 180. The accessory mounting bracket 190 includes an extension 192 that is adapted to receive a portion of the accessory. The accessory attachments 180 are preferably mounted in a spaced-apart relationship on the main beam 20, as illustrated in FIG. 19.

Figure 20:
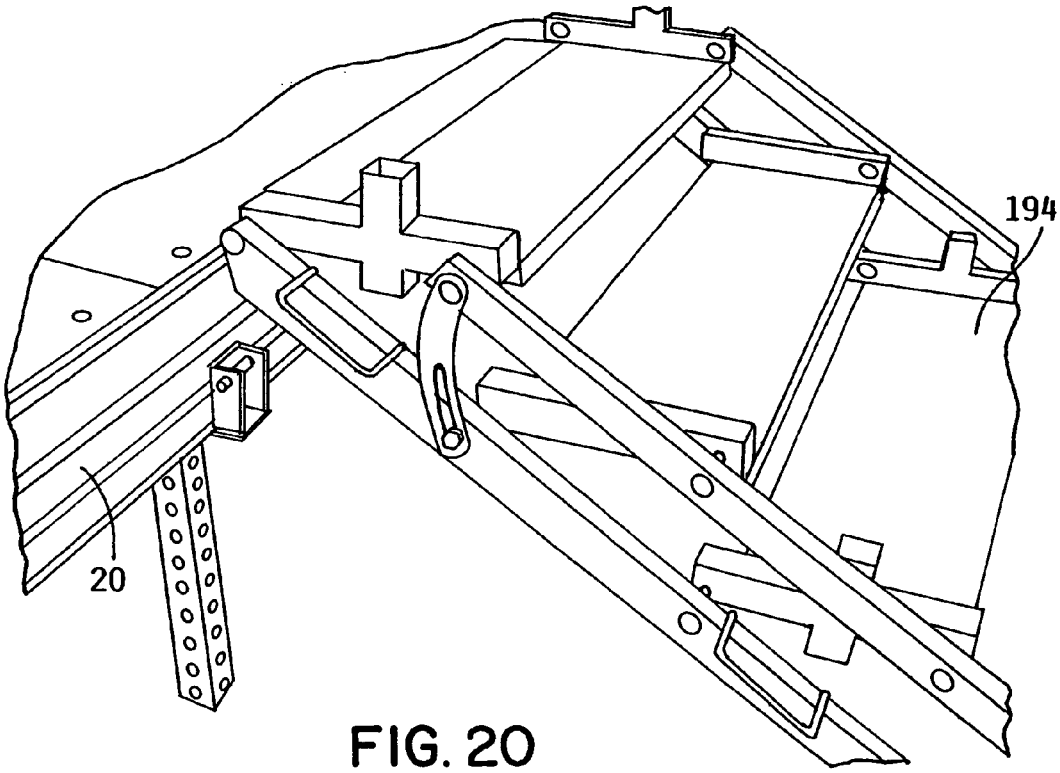
FIG. 20 is a side view of a stair assembly attached to the modular floor using the stair attachment bracket.
Figure 21:
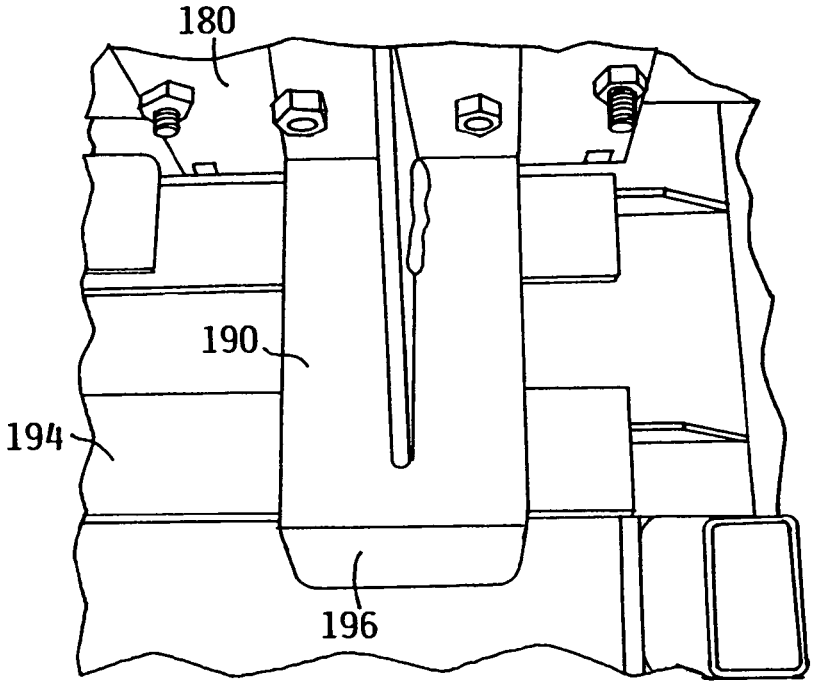
FIG. 21 is a bottom view of the stair assembly attached to the modular floor using the stair attachment bracket.
Figure 22:
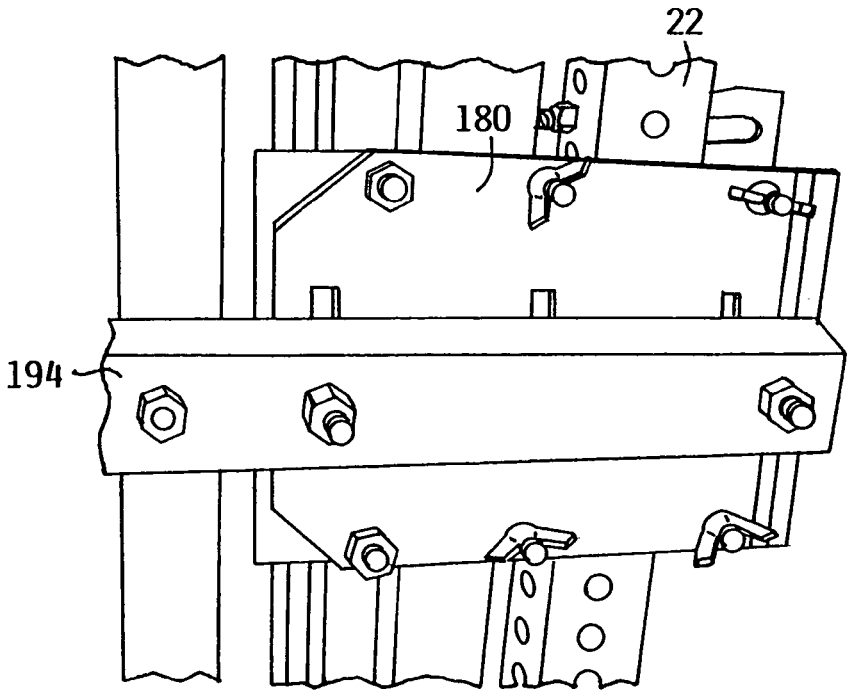
FIG. 22 is a side view of an alternative configuration of the accessory bracket attached to the cross beam.
Figure 23:
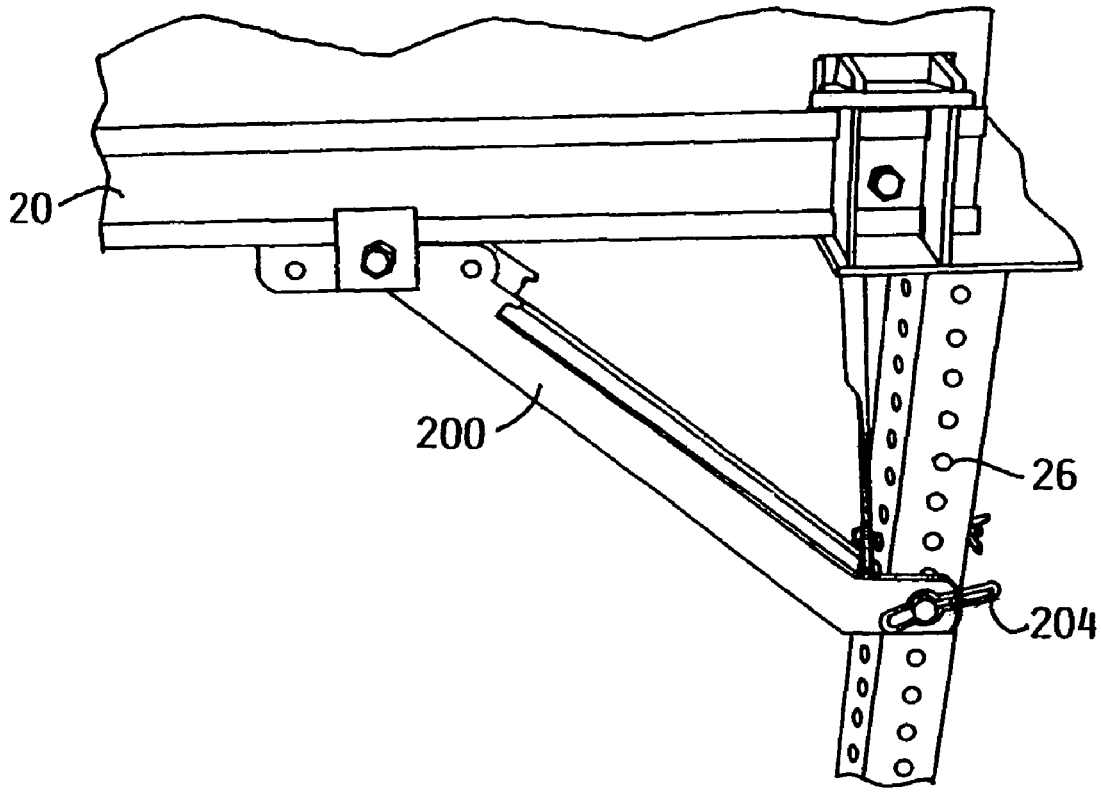
FIG. 23 is a side view of a main beam stabilizer in a use configuration.

The accessory 194 such as a set of stairs, as illustrated in FIG. 20, are placed over the accessory mounting bracket 190. An end of the accessory mounting bracket 190 preferably includes a lip 196, as illustrated in FIG. 21, to retain the accessory 194 on the accessory mounting bracket 190.

An alternative configuration of the accessory 194 includes a vertically oriented post that is attached to the accessory attachment 180. The vertically oriented post is preferably used in conjunction with a railing assembly (not shown).

Depending on the height of the modular floor 10, it may be desirable to use a main beam stabilizer 200 or a cross beam stabilizer 202, as illustrated in FIGS. 23-26, to further enhance the stability of the modular floor 10.

Figure 24:
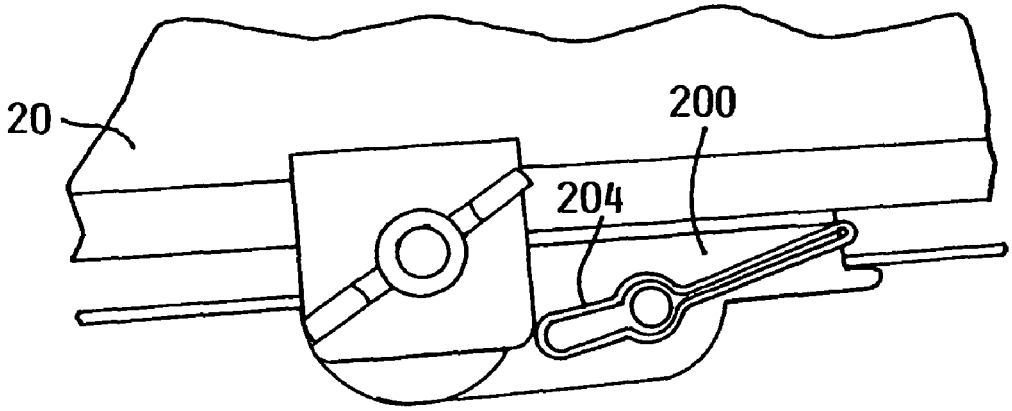
FIG. 24 is a side view of the main beam stabilizer in a storage configuration.
Figure 25:
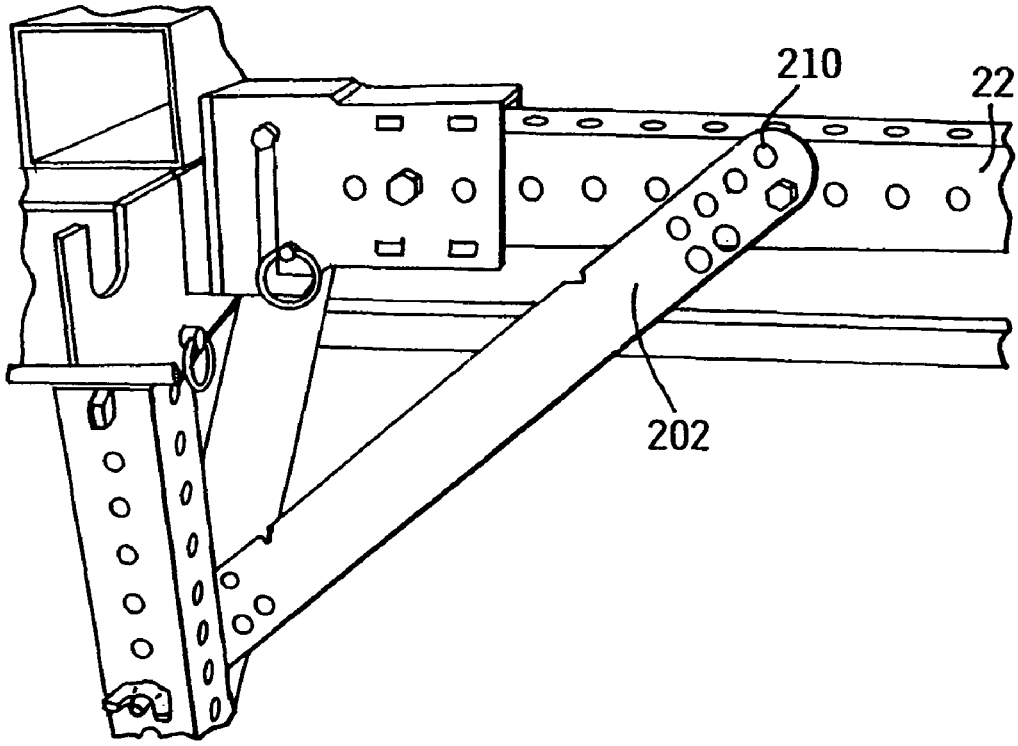
FIG. 25 is a side view of a side beam stabilizer in a use configuration.

The main beam stabilizer 200 is pivotable between a use configuration (FIG. 23) and a storage configuration (FIG. 24). When in the use configuration, the main beam stabilizer 200 is attached to both the main beam 20 and the leg 26. When in the storage configuration, the main beam stabilizer 200 is substantially recessed within a lower surface of the main beam 20. Preferably a clip 204 that is used to attach the main beam stabilizer 200 to the legs 26 is also used to retain the main beam stabilizer 200 in the storage configuration.

Figure 26:
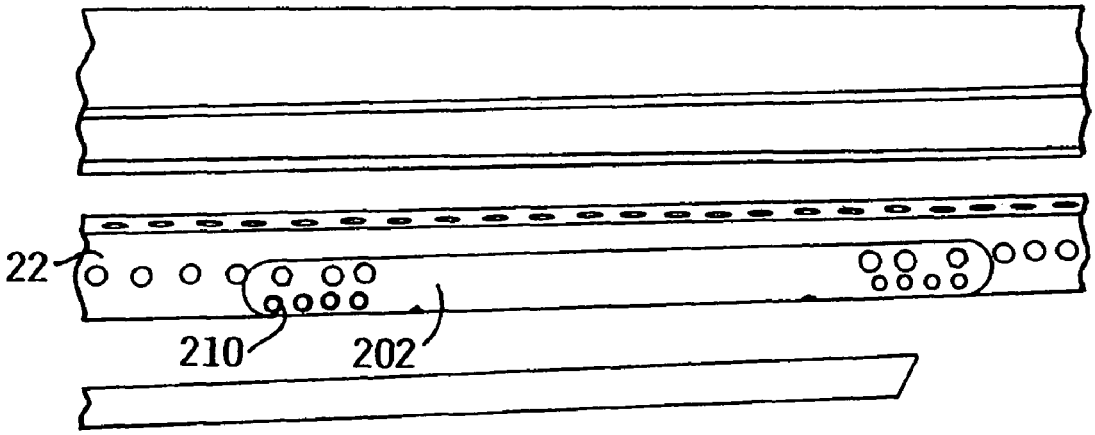
FIG. 26 is a side view of the side beam stabilizer in a storage configuration.

Similarly, the cross beam stabilizer 202 is pivotable between a use configuration (FIG. 25) and a storage configuration (FIG. 26). When in the use configuration, the cross beam stabilizer 202 is attached to both the cross beam 22 and the leg 26. When in the storage configuration, the cross beam stabilizer 202 is substantially aligned with the cross beam 22 with both ends of the cross beam stabilizer 202 being attached to the cross beam 22 with screws. Each of the cross beam stabilizer 202 preferably includes an array of apertures 210. Using the array of apertures 210 facilitates aligning one of the apertures with an aperture on the cross beam 22 or the leg 26.

Unless otherwise noted, the components of the modular floor 10 are preferably fabricated from extruded aluminum to provide the modular floor 10 with a relatively low weight. However, a person of ordinary skill in the art will appreciate that it is possible to fabricate the modular floor 10 from other materials using the concepts of the present invention.

In operation, the main beams 20 are placed so that the first end 30 is adjacent the second end 32. The main beams 20 are attached to each other by engaging the bolt 60 with the locking mechanism 70. This process is repeated until a desired length is obtained. Additional main beams 20 are prepared in a similar manner.

Main beams are then attached together using the cross beam 22 by extending the hooks 92 over the post 82. The bolt 94 is then extended through the side attachment walls 80 and the side walls 90. This process is repeated as needed to thereby form a grid.

Next, the floor panels 24 are placed on the grid so that the second sections 158 are seated on the attachment structures 50. The floor panels 24 are attached to the grid by screwing the locking screw 170 until the second end 182 engages the threaded surface on the channel 56.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A modular floor comprising:

first and second main beams, each main beam including an upper surface and a side wall, the side wall defining a main beam length and including at least one track structure;

a first cross beam;

a locking mechanism configured to releasably receive the first main beam and the second main beam in respective locked positions, the locking mechanism further configured to removably receive the first ground-engaging leg, the locking mechanism including a first lock and a second lock oriented to releasably receive the first main beam and the second main beam respectively in abutting registry with the side wall track structure of the first main beam substantially aligned with the side wall track structure of the second main beam when the first main beam and the second main beam are in the locked positions;

an attachment bracket configured to operably couple the first cross beam substantially transverse to the first main beam, the attachment bracket slidably receivable by the side wall track structure of the first main beam and the side wall track structure of the second main beam and shiftable along and between the side wall track structure of the first main beam and the side wall track structure of the second main beam when the first main beam and the second main beam are received by the first lock and the second lock of the locking mechanism in the locked positions; and a floor panel having floor coupling structure slidable on the upper surface of the first main beam with respect to the main beam length.

2. The modular floor of claim 1, wherein the upper surface of the first main beam has a substantially convex shape configured to gravitationally support the floor coupling structure.

3. The modular floor of claim 1, wherein the first cross beam includes a main section and an end section, the end section comprising a sleeve configured to receive the main section and engagement structure configured to couple with the attachment bracket.

4. The modular floor of claim 1, wherein the the upper surface of the first main beam comprises first and second rail portions, the floor coupling structure of the floor panel configured to conformingly bear upon the first and second rail portions.

5. The modular floor of claim 1, further comprising:

a first ground-engaging leg;

wherein the locking mechanism is further configured to removably receive the first ground-engaging leg.

6. The modular floor of claim 5, further comprising:

a stabilizer beam pivotally couplable to the first cross beam and removably couplable to the first ground-engaging leg.

7. The modular floor of claim 5, wherein the first ground-engaging leg is shiftable with respect to the locking mechanism for adjusting a height of the modular floor.

8. The modular floor of claim 1, wherein the attachment bracket is slidable from the first main beam onto the second main beam without disengaging from the first main beam.

9. The modular floor of claim 1, further comprising a brake mechanism configured to substantially prevent shifting of the attachment bracket with respect to the first main beam.

10. The modular floor of claim 1, wherein each of the first and second main beams comprises a post substantially transverse to the main beam length, the first and second locks of the locking mechanism configured to releasably engage the post of the first and second main beams.

11. The modular floor of claim 1, further comprising:

a third main beam;

a second cross beam, each of the first and second cross beams having first and second ends;

a plurality of ground-engaging legs;

a plurality of attachment brackets; and a plurality of locking mechanisms;

wherein each of the first and second ends of the first and second cross beams is couplable to one of the main beams with one of the plurality of attachment brackets;

each of the first and third main beams is couplable to a pair of the plurality of locking mechanisms;

each of the plurality of locking mechanisms is couplable to one of the plurality of ground-engaging legs; and the floor panel has additional floor coupling structure such that the floor coupling structures are gravitationally supportable by and slidable on the first and third main beams.

12. The modular floor of claim 11, wherein the modular floor defines a length and a width, the modular floor length being extendable by coupling additional main beams in abutting registry with the first and second main beams.

13. The modular floor of claim 12, wherein the locking mechanism includes a latch shiftable between a latched and an unlatched position, the latched biased toward the latched position.

14. A method of assembling a modular floor, the method comprising:

releasably receiving a first main beam and a second main beam in respective locked positions with first and second locks of a locking mechanism, each beam including an upper surface and a side wall, the side wall defining a main beam length and including at least one track structure;

locking the first main beam in abutting registry with the second main beam and substantially aligning the side wall track structure of the first main beam with the side wall track structure of the second main beam when the first main beam and the second main beam are in the locked positions;

coupling a first cross beam transverse to the first main beam with an attachment bracket;

releasably engaging the side wall track structure of one of the first main beam or the second main beam with the attachment bracket;

shiftably positioning the attachment bracket along and between the side wall track structure of the first main beam and the side wall track structure of the second main beam;

supporting a floor panel with a first main beam; and sliding the floor panel on the first main beam with respect to the main beam length.

15. The method of claim 14, further comprising:

coupling a second main beam in abutting registry with the first main beam.

16. The method of claim 14, further comprising:

shifting the attachment bracket from the first main beam to the second main beam without disengaging the attachment bracket from the first main beam.

17. The method of claim 14, further comprising:

removably receiving a first ground-engaging leg with the locking mechanism.

18. The method of claim 14, further comprising:

securing the attachment bracket to the first main beam to substantially prevent shifting of the attachment bracket with respect to the first main beam.

19. The method of claim 14, further comprising:

coupling a second locking mechanism to the first main beam;

coupling third and fourth locking mechanism to a second main beam;

coupling the second, third, and fourth locking mechanisms to ground-engaging legs;

coupling the first cross beam substantially transverse to the second main beam length with a second attachment bracket;

coupling a second cross beam substantially transverse to the first and second main beam length with third and fourth attachment brackets;

sliding the first and second attachment brackets on the first and second main beams, respectively, with respect to the main beam length;

sliding the third and fourth attachment brackets on the first and second main beams, respectively, with respect to the main beam length;

supporting the floor panel with the second main beam; and sliding the floor panel on the first and second main beams with respect to the main beam length.

20. The method of claim 14, wherein shifting the attachment bracket comprises shifting the first cross beam with respect to the main beam length.

21. A modular floor comprising:

first and second main beams each main beam including an upper surface and a side wall, the side wall defining a main beam length and including at least one track structure;

a first cross beam;

a floor panel;

a locking means for releasably receiving the first main beam and the second main beam in respective locked positions and for locking the first main beam and the second main beam respectively in abutting registry with the side wall track structure of the first main beam substantially aligned with the side wall track structure of the second main beam when the first main beam and the second main beam are in the locked positions;

an attachment means for operably coupling the first cross beam substantially transverse to the first main beam, the attachment means slidably receivable by the side wall track structure of the first main beam and the side wall track structure of the second main beam and shiftable along and between the side wall track structure of the first main beam and the side wall track structure of the second main beam when the first main beam and the second main beam are received by the locking means in the locked positions.

22. The modular floor of claim 21, further comprising:

a first ground-engaging leg;

wherein the locking means is further configured to removably receive the first ground-engaging leg.

23. The modular floor of claim 21, further comprising:

means for extending a length of the modular floor; and means for extending a width of the modular floor.

24. The modular floor of claims claim 21, further comprising:

means for adjusting a height of the modular floor.

* * * * *

UNITED STATES PATENT AND TRADEMARK OFFICE

CERTIFICATE OF CORRECTION

PATENT NO. : 7,874,115 B2
APPLICATION NO. : 10/773571
DATED : January 25, 2011
INVENTOR(S) : Thiede It is certified that error appears in the above-identified patent and that said Letters Patent is hereby corrected as shown below:

Column 2, Line 35:
After "is" insert --a--.

Column 3, Line 4:
Delete "proximate" and insert --Proximate--.

Column 4, Line 33:
Delete "be" and insert --the--.

Column 5, Line 18:
Delete "are" and insert --is--.

Signed and Sealed this
Thirtieth Day of August, 2011

David J. Kappos

David J. Kappos
*Director of the United States Patent and Trademark Office*